US005814944A

United States Patent [19]

Saito et al.

[11] Patent Number: 5,814,944

[45] Date of Patent: Sep. 29, 1998

[54] HIGH PRESSURE SODIUM VAPOR LAMP WITH HIGH COLOR RENDERING

[75] Inventors: Naoki Saito; Atsunori Okada; Taku Sumitomo; Koji Nishioka, all of Kadoma, Japan

[73] Assignee: Matsushita Electric Works, Ltd., Osaka, Japan

[21] Appl. No.: 783,443

[22] Filed: Jan. 16, 1997

[30] Foreign Application Priority Data

| | | | |
|---|---|---|---|
| Jan. 22, 1996 | [JP] | Japan | 8-008743 |
| Apr. 22, 1996 | [JP] | Japan | 8-100531 |
| Nov. 21, 1996 | [JP] | Japan | 8-310235 |

[51] Int. Cl.[6] ..... H01J 17/20

[52] U.S. Cl. ..... 313/638; 313/637; 313/639; 313/642

[58] Field of Search ..... 313/570, 571, 313/637, 638, 639, 640, 641, 642

[56] References Cited

U.S. PATENT DOCUMENTS

| | | | |
|---|---|---|---|
| 4,146,813 | 3/1979 | van Vliet . | |
| 4,910,432 | 3/1990 | Brown et al. | 313/642 |
| 5,097,176 | 3/1992 | De Hair et al. . | |

FOREIGN PATENT DOCUMENTS

| | | |
|---|---|---|
| 49-11818 | 3/1974 | Japan . |
| 7-272680 | 10/1995 | Japan . |

*Primary Examiner*—Nimeshkumar Patel
*Attorney, Agent, or Firm*—Burns, Doane, Swecker & Mathis, L.L.P.

[57] ABSTRACT

High-pressure sodium vapor lamp with high color rendering including, in an arc tube of a light transmitting material formed in a substantially cylindrical shape sealed hermetically at both axial ends, a pair of electrodes disposed internally at both axial ends of the tube and xenon gas of at least $2.5\times10^4$ (Pa) sealed in the tube together with sodium vapor, is so constituted that a lamp voltage upon lighting of the lamp and represented by V (V as a unit), lamp power represented by W (watt), internal diameter of the arc tube represented by $\phi$ (mm) and distance between the pair of electrodes represented by d (mm) will satisfy the following formulas:

$$2.0 \leq V/d \leq 2.7 \quad (1)$$

and $$20 \leq W/\phi \leq 28 \quad (2)$$

15 Claims, 2 Drawing Sheets

HIGH PRESSURE SODIUM VAPOR LAMP WITH HIGH COLOR RENDERING

BACKGROUND OF THE INVENTION

This invention relates to high pressure sodium vapor lamps and, more particularly, to a high pressure sodium vapor lamp of a high color rendering close to that of incandescent lamp.

DESCRIPTION OF RELATED ART

The high-pressure sodium vapor lamps with high color rendering of this kind have been realized and provided to practical use in the form in which, as has been disclosed in Japanese Patent Publication No. 49-11818, xenon gas, sodium as a luminous substance, and such metals as mercury, cadmium and the like for generation of buffer gas are sealed in a discharge tube consisting of light transmitting alumina ceramic or single crystal alumina.

In Japanese Patent Laid-Open Publication No. 7-272680, further, there has been disclosed that the lamp is made not to easily flicker out and can be prolonged in the life by sealing in the discharge tube a starting rare gas, more than 0.11 mg/cm$^3$ of sodium and less than 0.01 mg/cm$^3$ of mercury. In U.S. Pat. No. 4,146,813, it has been disclosed that a mercury-less high pressure sodium vapor lamp of a high efficiency can be obtained by sealing xenon gas and sodium in an arc tube, and properly setting the vapor pressure ratio of xenon and sodium during the lighting, the inner diameter of the arc tube, the relationship between the sodium vapor pressure and the inner diameter of the tube and so on. Further, in U.S. Pat. No. 5,097,176, there has been disclosed a high pressure sodium vapor lamp with high color rendering and high color temperature, obtained by elevating the lamp tube wall loading to be more than 60 W/cm$^2$, charging a gas in outer tube, and optimizing the inner diameter of the arc tube and the distance between electrodes, which is put to the practical use as a lamp of a relatively low watt less than 100 W. In these known high-pressure sodium vapor lamps with high color rendering, however, there have been such various problems that the metallic sodium reacts to materials forming the arc tube and disappears at the end of the performance, so as to elevate the ratio of mercury to sodium, and the color of light shifts to be pinkish; that the lamp structure is caused to be complicated and made high in the costs due to the necessity of providing the heat protecting layer at the ends of the arc tube; and that the lamp of such high watt as 400 W is uneasy to be adapted to practical use in a high loading.

SUMMARY OF THE INVENTION

An object of the present invention is, therefore, to provide a high-pressure sodium vapor lamp with high color rendering which has eliminated the foregoing problems.

According to the present invention, the above object can be realized by means of a high pressure sodium vapor lamp with high color rendering of a double tube structure in which a rare gas and metallic sodium are sealed in an inner arc tube, that is, alkali resistant and having electrodes at both ends, and an inert gas is sealed in an outer envelope, characterized in that a general color rendering index Ra is made more than 80 and the color temperature is made more than 2,400K, by setting the sealing pressure of the rare gas to be higher than a predetermined value. As an additional feature, a tube wall loading of the arc tube is set to be within a predetermined range, so that the tube wall temperature of the arc tube under a rated lamp wattage is made below 1,200° C.

Other objects and advantages of the present invention shall become clear as the following description of the invention advances as detailed with reference to preferred embodiments of the invention as shown in accompanying drawings.

Thus, the high-pressure sodium vapor lamp according to the present invention can show a high color rendering property which provides the warm light which is extremely close resembling that of the incandescent lamp and does not vary the light color to be pinkish throughout the life of the lamp.

While the present invention should now be described with reference to the preferred embodiments shown in the accompanying drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

EMBODIMENT 1

Figure 1:
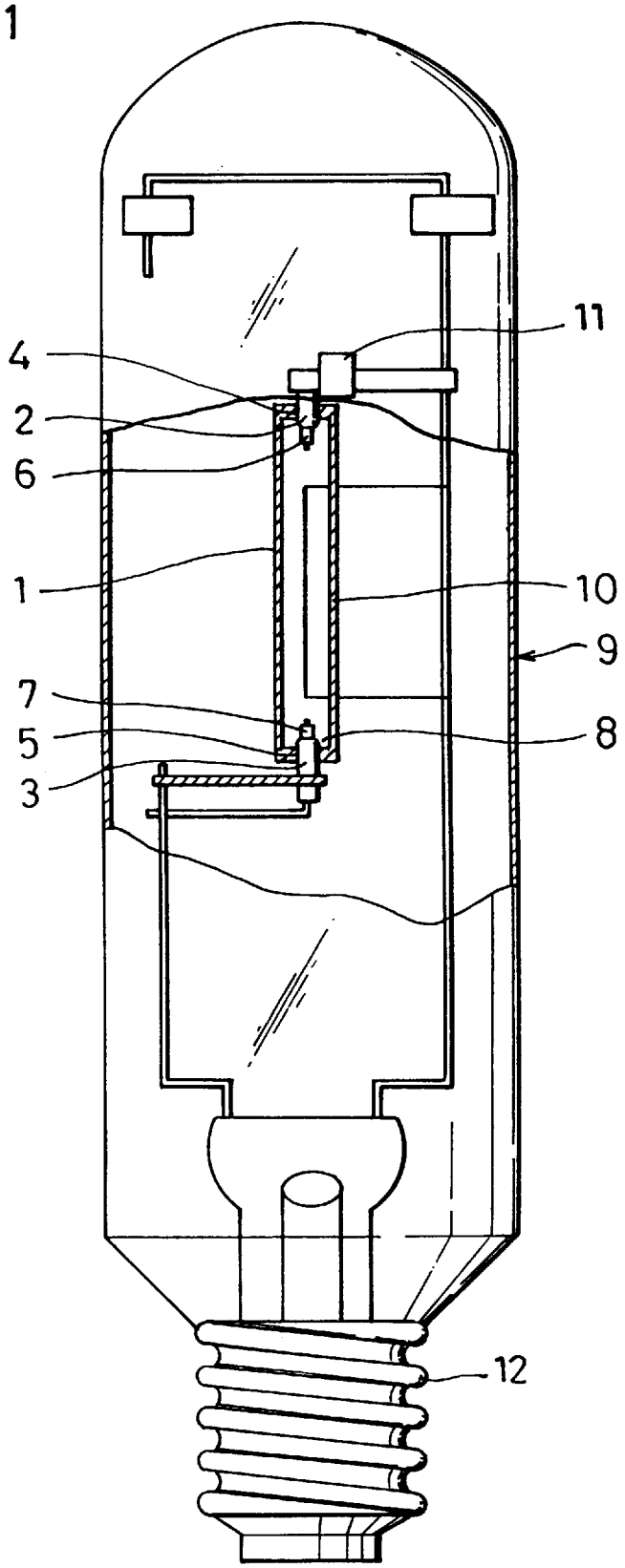
FIG. 1 shows in a front view with part shown as sectioned a high-pressure sodium vapor lamp with high color rendering in an embodiment according to the present invention.

The high-pressure sodium vapor lamp of such Embodiment 1 as shown in FIG. 1 comprises an arc tube 1 consisting of light transmitting polycrystalline alumina, which tube is formed to be dimensioned, for example, 5.5 mm in the inner diameter, 6.9 mm in the outer diameter and 34 mm in the entire length. At both ends of this arc tube 1, electrical conductors 2 and 3 consisting of, for example, niobium (Nb) and 1% of zirconium (Zr) are hermetically secured to the arc tube 1 through frits 4 and 5 made of, for example, aluminum oxide ($Al_2O_3$), yttrium oxide ($Y_2O_3$), strontium oxide (SrO) and calcium oxide (CaO). Electrodes 6 and 7 are held at tip ends of the electrical conductors 2 and 3 on their inner side of the tube 1 and for example, yttrium oxide ($Y_1O_2$) is coated and then sintered on the electrodes 6 and 7 as an emitter, though not shown. The electrodes 6 and 7 are mutually separated by 22 mm, for example. Thus, the arc tube 1 is made to have a tube wall loading of, for example, 39.5 W/cm$^2$, and an attachment 8 of, for example, 3 mg of metallic sodium and xenon gas (not shown) area sealed in the tube at, for example, $4\times10^4$ Pa (25° C.).

The above arc tube 1 is held within an outer envelope 9 of, for example, a hard glass of 40 mm in diameter, and nitrogen gas is sealed in this outer envelope 9 at $2.7\times10^4$ Pa (25° C.), for example. A probe 10 is provided along outer peripheral wall of the arc tube 1 to lie nearly between both electrodes 6 and 7, as an arrangement for rendering the starting of the lamp to be easier upon a voltage application. Further, a getter 11 of, for example, zirconium-aluminum (Zr-Al) is provided for adsorption of hydrogen within the outer envelope 9 to restrain the starting voltage from being raised, and a lamp base 12 is provided at one end of the outer envelope 9.

When this lamp was operated with a choke type ballast incorporating an igniter, with a lamp wattage of 150 W; the lamp has shown a lamp efficiency of 611 m/W, color temperate of 2,620K, and such high color rendering as 84 in the general color rendering index Ra, its chromaticity point was +0.001 that was present almost on the black body locus, and the tone of light color never became greenish.

Ten lamps of the specification of Embodiment 1 were manufactured and were subjected to a lighting experiment at an ON/OFF cycle of lighting ON for 5.5 hours and lighting OFF for 0.5 hours. Even after 12,000 hours in total lighting hours, they were all still able to be lighted without extinction, and an improvement was attained in the lamp voltage rise during the lighting to be 2.1 V in the average of the ten lamps and, at the most, 4.6 V. In this case, there has occurred no state in which the arc tube 1 is caused to leak.

Next, the lamps were subjected to another experiment in which the inner diameter of the arc tube and the distance between the electrodes thereof were made constant to be 5.5 mm and 22 mm respectively, but the pressure of sealed xenon gas was varied to be such six different levels as shown in a following Table 1, so as to measure the effect occurring in the respective lamps. In the outer envelope 9, nitrogen gas was sealed at about $2.7\times10^4$ Pa (25° C.) . It has been found that, with xenon gas less than $2.5\times10^4$ Pa, the xenon gas cannot play sufficiently the roll of the buffer gas, and thus the general color rendering index Ra or such optical characteristics as the color temperature is deteriorated. Further, deviation of the chromaticity point from the black body locus was less than ±0.002. When, on the other hand, the pressure of the xenon gas exceeds $5.3\times10^4$ Pa, the general color rendering index Ra was lowered to be less than 80, but the saturation was made higher to the contrary and an object illuminated could be enlarged chroma.

TABLE 1

| | | | | | | |
|---|---|---|---|---|---|---|
| Xe Gas Press. ($\times10^4$ Pa) | 2.3 | 2.5 | 4.0 | 4.8 | 5.3 | 6.1 |
| Gen. Col. Rend. Index. Ra | 77 | 87 | 84 | 81 | 80 | 78 |
| Col. Temp. (K) | 2390 | 2400 | 2620 | 2660 | 2710 | 2780 |
| Diviat. of Chromat. Pt. (×1000) | 2.4 | 1.8 | 0.1 | −0.2 | −0.9 | −1.2 |

Next, the lamps were manufactured for trial by rendering the inner diameter of the arc tube made of light transmitting polycrystalline alumina to be constantly 5.5 mm, but varying the distance between the electrodes, that is, tube wall loading, to be as shown in a following Table 2. Xenon gas was made to be $4\times10^4$ Pa and sodium was made to be 3 mg. At the same time, nitrogen gas was charged in the outer envelope 9 to be $2.7\times10^4$ (25° C.).

TABLE 2

| | | | | | | |
|---|---|---|---|---|---|---|
| Tube Wall Loading (W/cm$^2$) | 32.2 | 34.7 | 39.5 | 49.6 | 62.0 | 72.3 |
| Dist. Betw. Electrodes (mm) | 27 | 25 | 22 | 17.5 | 14 | 12 |
| Gen. Col. Rend. Index. Ra | 78 | 80 | 84 | 87 | 83 | 77 |
| Col. Temp. (K) | 2380 | 2520 | 2620 | 2680 | 2725 | 1780 |
| Tube Temp. (°C.) | 1075 | 1090 | 1120 | 1160 | 1200 | 1220 |

From the results shown in the above Table 2, it has been found that the high color rendering exhibits both in the general color rendering index Ra and color temperature when the tube wall loading was more than 34.7 W/cm$^2$. It has been also found, on the other hand, that, as the tube wall loading exceeds 62 W/cm$^2$, the tube wall temperature exceeds 1,200° C., whereby the reaction speed between the polycrystalline alumina and metallic sodium forming the arc tube is elevated, so as to be not preferable.

Further, the lamps were manufactured for trial, by making the distance between the electrodes in the arc tube made of the light transmitting polycrystalline alumina to be 22 mm, but varying the inner diameter of the tube, that is, the tube wall loading as shown in a following Table 3. Xenon gas was made to be $4\times10^4$ Pa and sodium was 3 mg. In an outer envelope of a diameter of 40 mm, nitrogen gas was charged to be $2.7\times10^4$ (25° C.).

TABLE 3

| | | | | | | |
|---|---|---|---|---|---|---|
| Tube Wall Loading (W/cm$^2$) | 32.2 | 34.7 | 39.5 | 49.6 | 62.0 | 72.3 |
| Inner Dia. (mm) | 6.74 | 6.3 | 5.5 | 4.4 | 3.5 | 3.0 |
| Gen. Col. Rend. Index. Ra | 76 | 80 | 84 | 86 | 84 | 76 |
| Col. Temp. (K) | 2360 | 2500 | 2620 | 2660 | 2715 | 2750 |
| Tube Temp. (°C.) | 1085 | 1100 | 1120 | 1170 | 1200 | 1230 |

It has been found that, as shown in the above Table 3, the high color rendering both in the general color rendering index Ra and color temperature when the tube wall loading is more than 34.7 W/cm$^2$. On the other hand, the tube wall loading exceeding 62 W/cm$^2$ causes the tube wall temperature to exceed 1,200° C., so that the reaction speed between the polycrystalline alumina and metallic sodium is elevated, so as to be not preferable. For the inert gas to be charged in the outer envelope, such other gas as krypton gas than nitrogen gas has also shown the effect of lowering the surface temperature of the arc tube.

EMBODIMENT 2

The present embodiment, which employs the same structure as the above embodiment 1, includes an arc tube 1 made of light transmitting polycrystalline alumina and is dimensioned, for example, 5.5 mm in the inner diameter, 6.9 mm in the outer diameter and 34 mm in the entire length. At both ends of this arc tube 1, electrical conductors 2 and 3 made of, for example, niobium (Nb) and 1% of zirconium (Zr) are hermetically secured to the arc tube 1 through frits 4 and 5 made of, for example, aluminum oxide ($Al_2O_3$), yttrium oxide ($Y_2O_3$). strontium oxide (SrO) and calcium oxide (CaO). Electrodes 6 and 7 are held at tip ends of the electrical conductors 2 and 3 on their inner side of the tube 1 and for example, yttrium oxide ($Y_2O_3$) is coated and then sintered on the electrodes 6 and 7 as an emitter, though not shown. The electrodes 6 and 7 are mutually separated by 22 mm, for example. Thus, the arc tube 1 is made to have a tube wall loading of, for example, 39.5 W/cm$^2$, and an attachment 8 of, for example, 3 mg of metallic sodium and krypton gas (not shown) area sealed in the tube at, for example, $4\times10^4$Pa (25° C.).

The above arc tube 1 is held within an outer envelope 9 of, for example, a hard glass of 40 mm in diameter, and nitrogen gas is sealed in this outer envelope 9 at $2.7\times10^4$ Pa (25° C.), for example. A probe 10 is provided along outer peripheral wall of the arc tube 1 to lie nearly between both electrodes 6 and 7, as an arrangement for rendering the starting of the lamp to be easier upon a voltage application. Further, a getter 11 of, for example, zirconium-aluminum (Zr-Al) is provided for adsorption of hydrogen within the outer envelope 9 to restrain the starting voltage from being raised, and a lamp base 12 is provided at the one end of the outer envelope 9.

When this lamp was operated with a choke type ballast incorporating an igniter, with a lamp wattage of 150 W; the lamp has shown a lamp efficiency of 581 m/W, color temperate of 2,520K, and such high color rendering as 85 in the general color rendering index Ra, its chromaticity point was +0.001 that was present almost on the black body locus, and the tone of light color never became greenish.

Ten lamps of the specification of the embodiment 2 were manufactured and were subjected to a lighting experiment at an ON/OFF cycle of lighting ON for 5.5 hours and lighting OFF for 5 hours. Even after 12,000 hours in total lighting hours, they were all still able to be lighted without extinction, and an improvement was attained in the lamp voltage rise during the lighting to be 4.1 V in the average of the ten lamps and, at the most, 6.8 V.

Next, the lamps were subjected to another experiment in which the inner diameter of the arc tube and the distance between the electrodes thereof were made constant to be 5.5 mm and 22 mm respectively, but the pressure of sealed krypton gas was varied to be such six different levels as shown in a following Table 4, so as to measure the effect occurring in the respective lamps. In the outer envelope 9, nitrogen gas was sealed at about $2.7\times10^4$ Pa (25° C.) . It has been found that, with krypton gas less than $2.5\times10^4$ Pa, the krypton gas cannot play sufficiently the roll of the buffer gas, and thus the general color rendering index Ra or such optical characteristics as the color temperature is deteriorated. Further, deviation of the chromaticity point from the black body locus was less than ±0.002. When, on the other hand, the pressure of the krypton gas exceeds $5.3\times10^4$ Pa, the general color rendering index Ra was lowered to be less than 80, but the saturation was made higher to the contrary and an object illuminated could be enlarged chroma.

TABLE 4

| | | | | | | |
|---|---|---|---|---|---|---|
| Kr Gas Press. ($\times10^4$ Pa) | 2.3 | 3.0 | 4.0 | 4.8 | 5.3 | 6.1 |
| Gen. Col. Rend. Index Ra | 77 | 86 | 85 | 82 | 80 | 76 |
| Col. Temp. (K) | 2370 | 2400 | 2520 | 2660 | 2740 | 2820 |
| Diviat. of Chromat. Pt. (×1000) | 2.4 | 2.0 | 0.1 | −0.8 | −1.2 | −1.6 |

Next, the lamps were manufactured for trial by rendering the inner diameter of the arc tube made of light transmitting polycrystalline alumina to be constantly 5.5 mm, but varying the distance between the electrodes, that is, tube wall loading, to be as shown in a following Table 5. Krypton gas was made to be $4\times10^4$ Pa and sodium was made to be 3 mg. At the same time, nitrogen gas was charged in the outer envelope 9 to be $2.7\times10^4$ (25° C.).

TABLE 5

| | | | | | | |
|---|---|---|---|---|---|---|
| Tube Wall Loading (W/cm$^2$) | 32.2 | 36.1 | 39.5 | 45.7 | 54.3 | 72.3 |

TABLE 5-continued

| | | | | | | |
|---|---|---|---|---|---|---|
| Dist. Betw. Electrodes (mm) | 27 | 24 | 22 | 19 | 16 | 12 |
| Gen. Col. Rend. Index Ra | 77 | 80 | 85 | 84 | 82 | 78 |
| Col. Temp. (K) | 2370 | 2510 | 2610 | 2680 | 2700 | 2770 |
| Tube Temp. (°C.) | 1090 | 1100 | 1130 | 1170 | 1200 | 1210 |

From the results shown in the above Table 5, it has been found that the high color rendering exhibits both in the general color rendering index Ra and color temperature when the tube wall loading was more than 36.1 W/cm$^2$. It has been also found, on the other hand, that, as the tube wall loading exceeds 54.3 W/cm$^2$, the tube wall temperature exceeds 1,200° C., whereby the reaction rate between the polycrystalline alumina and metallic sodium forming the materials of the arc tube is elevated, so as to be not preferable.

Further, the lamps were manufactured for trial, by making the distance between the electrodes in the arc tube made of the light transmitting polycrystalline alumina to be 22 mm, but varying the inner diameter of the tube, that is, the tube wall loading as shown in a following Table 6. Xenon gas was made to be $4\times10^4$ Pa and sodium was 3 mg. In an outer envelope of a diameter of 40 mm, nitrogen gas was charged to be $2.7\times10^4$ (25° C.).

TABLE 6

| | | | | | | |
|---|---|---|---|---|---|---|
| Tube Wall Loading (W/cm$^2$) | 32.2 | 36.1 | 39.5 | 45.7 | 54.3 | 72.3 |
| Inner Dia. Of Tube (mm) | 6.74 | 6.0 | 5.5 | 4.75 | 4.0 | 3.0 |
| Gen. Col. Rend. Index Ra | 76 | 80 | 85 | 86 | 84 | 76 |
| Col. Temp. (K) | 2360 | 2500 | 2610 | 2660 | 2715 | 2750 |
| Tube Temp. (°C.) | 1065 | 1080 | 1130 | 1150 | 1200 | 1220 |

It has been found that, as shown in the above Table 6, when the tube wall loading exceeds 54.3 W/cm$^2$, the temperature of the tube wall exceeds 1200° C., whereby the reaction rate between the polycrystalline alumina and metallic sodium as the materials of the arc tube is elevated, so as to be not preferable.

For the inert gas to be charged in the outer envelope, such other gas as krypton gas than nitrogen gas has also shown the effect of lowering the surface temperature of the arc tube.

EMBODIMENT 3

The present embodiment, which employs the same structure as the above embodiment 1, includes an arc tube 1 made of light transmitting polycrystalline alumina and is dimensioned, for example, 5.5 mm in the inner diameter, 6.9 mm in the outer diameter and 34 mm in the entire length. At both ends of the arc tube 1, electrical conductors 2 and 3 made of, for example, niobium (Nb) and 1% of zirconium (Zr) are hermetically secured to the arc tube 1 through frits 4 and 5 made of, for example, aluminum oxide ($Al_2O_3$), yttrium oxide ($Y_2O_3$), strontium oxide (SrO) and calcium oxide (CaO). Electrodes 6 and 7 are held at tip ends of the electrical conductors 2 and 3 on their inner side of the tube 1 and for example, yttrium oxide ($Y_2O_3$) is coated and then sintered on the electrodes 6 and 7 as an emitter, though not shown. The electrodes 6 and 7 are mutually separated by 22 mm, for example. Thus, the arc tube 1 is made to have a tube wall loading of, for example, 39.5 W/cm$^2$, and an attachment 8 of, for example, 3 mg of metallic sodium and argon gas (not shown) area sealed in the tube at, for example, 4×10$^4$ Pa (25° C.).

The above arc tube 1 is held within an outer envelope 9 of, for example, a hard glass of 40 mm in diameter, and nitrogen gas is sealed in this outer envelope 9 at 2.7×10$^4$ Pa (25° C.), for example. A probe 10 is provided along outer peripheral wall of the arc tube 1 to lie nearly between both electrodes 6 and 7, as an arrangement for rendering the starting of the lamp to be easier upon a voltage application. Further, a getter 11 of, for example, zirconium-aluminum (Zr-Al) is provided for adsorption of hydrogen within the outer envelope 9 to restrain the starting voltage from being raised, and a lamp base 12 is provided at one end of the outer envelope 9.

When this lamp of the embodiment 3 was operated with a choke type ballast incorporating an igniter, with a lamp wattage of 150 W; the lamp has shown a lamp efficiency of 541 m/W, color temperate of 2,520K, and such high color rendering as 85 in the general color rendering index Ra, its chromaticity point was present almost on the black body locus, and the tone of light color never became greenish.

Ten lamps of the embodiment 3 were manufactured and were subjected to a lighting experiment at an ON/OFF cycle of lighting ON for 5.5 hours and lighting OFF for 0.5 hours. Even after 12,000 hours in total lighting hours, they were all still able to be lighted without extinction, and an improvement was attained in the lamp voltage rise during the lighting to be 3.9 V in the average of the ten lamps and, at the most, 6.1 V.

Next, the lamps were subjected to another experiment in which the inner diameter of the arc tube and the distance between the electrodes thereof were made constant to be 5.5 mm and 22 mm respectively, but the pressure of sealed xenon gas was varied to be such six different levels as shown in a following Table 7, so as to measure the effect occurring in the respective lamps. In the outer envelope 9, nitrogen gas was sealed at about 2.7×10$^4$ Pa (25° C.). It has been found that, with argon gas less than 3.3×10$^4$ Pa, the argon gas cannot play sufficiently the roll of the buffer gas, and thus the general color rendering index Ra or such optical characteristics as the color temperature is deteriorated. Further, deviation of the chromaticity point from the black body locus was less than ±0.002. When, on the other hand, the pressure of the argon gas exceeds 5.3×10$^4$ Pa, the general color rendering index Ra was lowered to be less than 81, but the saturation was made higher to the contrary and an object illuminated could be enlarged chroma.

TABLE 7

| | | | | | | |
|---|---|---|---|---|---|---|
| Ar Gas Press. (×10$^4$ Pa) | 3.0 | 3.3 | 4.0 | 4.8 | 5.3 | 6.1 |
| Gen. Col. Rend. Index Ra | 78 | 80 | 85 | 83 | 81 | 76 |
| Col. Temp. (K) | 2380 | 2400 | 2520 | 2560 | 2620 | 2690 |
| Diviat. of Chromat. Pt. (×1000) | 2.6 | 2.0 | 0.2 | −0.9 | −1.5 | −1.9 |

Next, the lamps were manufactured for trial by rendering the inner diameter of the arc tube made of light transmitting polycrystalline alumina to be constantly 5.5 mm, but varying the distance between the electrodes, that is, tube wall loading, to be as shown in a following Table 8. Argon gas was made to be 4×10$^4$ Pa and sodium was made to be 3 mg. At the same time, nitrogen gas was charged in the outer envelope 9 to be 2.7×10$^4$ (25° C.).

TABLE 8

| | | | | | | |
|---|---|---|---|---|---|---|
| Tube Wall Loading (W/cm$^2$) | 32.2 | 34.7 | 39.5 | 49.6 | 55.7 | 72.3 |
| Dist. Betw. Electrodes (mm) | 27 | 25 | 22 | 17.5 | 15.6 | 12 |
| Gen. Col. Rend. Index Ra | 76 | 78 | 84 | 85 | 86 | 86 |
| Col. Temp. (K) | 2310 | 2350 | 2480 | 2520 | 2560 | 2620 |
| Tube Temp. (°C.) | 1090 | 1100 | 1130 | 1170 | 1200 | 1215 |

From the results shown in the above Table 8, it has been found that the high color rendering exhibits both in the general color rendering index Ra and color temperature when the tube wall loading was more than 39.5 W/cm$^2$. It has been also found, on the other hand, that, as the tube wall loading exceeds 55.7 W/cm$^2$, the tube wall temperature exceeds 1,200° C., whereby the reaction rate between the polycrystalline alumina and metallic sodium forming the materials of the arc tube is elevated, so as to be not preferable.

Further, the lamps were manufactured for trial, by making the distance between the electrodes in the arc tube made of the light transmitting polycrystalline alumina to be 22 mm, but varying the inner diameter of the tube, that is, the tube wall loading as shown in a following Table 9. Argon gas was made to be 4×10$^4$ Pa and sodium was 3 mg. In an outer envelope of a diameter of 40 mm, nitrogen gas was charged to be 2.7×10$^4$ (25° C.).

TABLE 9

| | | | | | |
|---|---|---|---|---|---|
| Tube Wall Loading (W/cm$^2$) | 34.7 | 39.5 | 49.6 | 55.7 | 72.3 |
| Inner Dia. Of Tube (mm) | 6.3 | 5.5 | 4.4 | 3.9 | 3.0 |
| Gen. Col. Rend. Index Ra | 76 | 80 | 82 | 86 | 84 |
| Col. Temp. (K) | 2460 | 2500 | 2610 | 2660 | 2715 |
| Tube Temp. (°C.) | 1065 | 1080 | 1110 | 1200 | 1250 |

It has been found that, as shown in the above Table 9, the high color rendering exhibits both in the general color rendering index Ra and color temperature when the tube wall loading was more than 39.5 W/cm$^2$. When the tube wall loading exceeds 55.7 W/cm$^2$, the temperature of the tube wall exceeded 1200° C., whereby the reaction rate between the polycrystalline alumina and metallic sodium as the materials of the arc tube is elevated, so as to be not preferable. For the inert gas to be charged in the outer envelope, such other gas as krypton gas than nitrogen gas has also shown the effect of lowering the surface temperature of the arc tube.

EMBODIMENT 4

Figure 2:
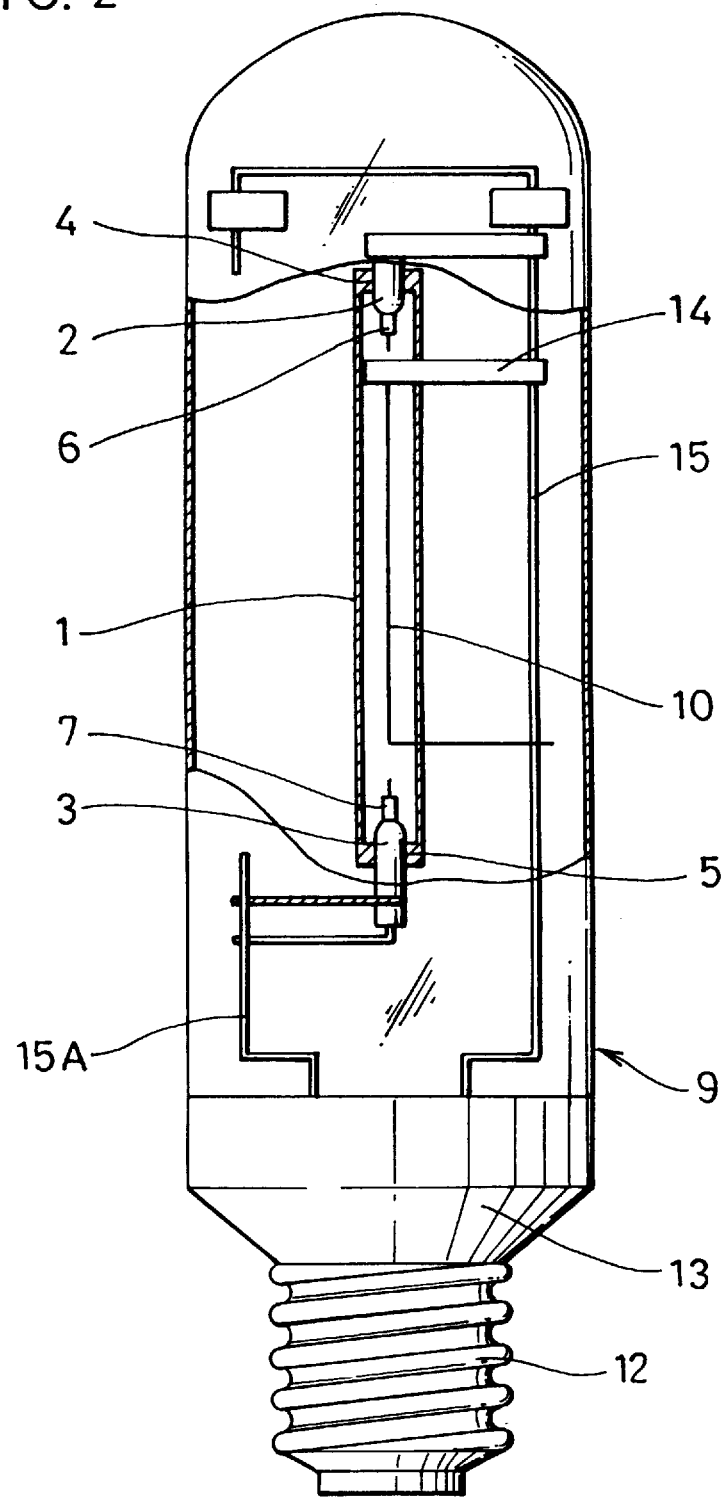
FIG. 2 shows in a front view with part shown as sectioned the high-pressure sodium vapor lamp with high color rendering in another embodiment according to the present invention.

Referring to FIG. 2, there is shown a basic arrangement of high pressure sodium vapor lamps with high color rendering in accordance with fourth and fifth embodiments of the present invention. Explanation will first be made as to the fourth embodiment by referring to the same drawing. This high pressure sodium vapor lamp comprises an arc tube 1, an outer envelope 9 for accommodating the arc tube 1, the outer envelope being provided at its one end with a lamp base 12, a supporting rod 15 for holding the arc tube 1 within the outer envelope 9, and electrodes 6 and 7 provided at tip ends of electrically electrical conductors 2 and 3 and at both ends of the arc tube 1.

More in detail, the arc tube 1 is made in the form of a substantially cylindrical shape, and made of, for example, an alkali-resistive transparent member such as light transmitting ceramic (e.g., polycrystalline alumina or polycrystalline yttrium), single crystal alumina or the like. The arc tube is dimensioned, for example, 6 mm in the inner diameter, 7.4 mm in the outer diameter and 60 mm in the entire length. At both ends of the arc tube 1, electrical conductors 2 and 3 made of, for example, niobium (Nb) and 1% of zirconium (Zr) are inserted into openings at the both ends of the tube to be hermetically secured to the ends of the arc tube 1 through frits 4 and 5 made of, for example, aluminum oxide ($Al_2O_3$), yttrium oxide ($Y_2O_3$), strontium oxide (SrO) and calcium oxide (CaO). A distance d between the electrodes 6 and 7 held to the both ends of the tube 1 is made to be 40 mm, and for example, yttrium oxide ($Y_2O_3$) is coated and then sintered on the electrodes 6 and 7 as an emitter. Sealed in a discharge space as the inside space of the arc tube 1 are, for example, 5 mg of metallic sodium and xenon gas at a gas pressure of $4\times10^4$ Pa at a temperature of 25° C.

The outer envelope 9 made of hard glass is made to be, for example, 40 mm in the diameter. In the substantially cylindrical space for enclosure of the arc tube 1, a lamp base 12 disposed at one end is connected to a pair of electrically conductive supporting rods 15 and 15A, by which the arc tube 1 is supported. A barium getter 13 is used to evacuate the inside space air from the tube to put it in a high vacuum level. A probe 10 is connected to one of the supporting rods 15 and 15A along the outer wall of the arc tube 1 nearly between the both electrodes 6 and 7 to apply a predetermined potential thereto to facilitate starting of the lamp. The probe 10 is connected at its one end via bimetal 14 to the supporting rod 15 so that the probe 10 is prevented from coming into contact with the outer wall of the arc tube 1 during the operating of the lamp.

When the high pressure sodium vapor lamp thus arranged was operated with a choke type ballast incorporating an igniter, with a lamp wattage (lamp power) of 150 W; the lamp has shown such good lighting characteristics as a lamp efficiency η of 561 m/W, color temperate of 2,570K, and such high color rendering as 85 in the general color rendering index Ra. In this case, assuming that a lamp voltage upon the operating is denoted by V(V), the inner diameter of the arc tube 1 is by ϕ(mm), the distance between the electrodes 6 and 7 is by d (mm); then relationships of V/d=2.0 and W/ϕ=25 were satisfied. Twenty of the high pressure sodium vapor lamps having the same arrangement were manufactured and were subjected to a lighting experiment at an ON/OFF cycle of lighting ON for 5.5 hours and lighting OFF for 0.5 hours, with use of a choke type ballast incorporating an igniter. Even after 12,000 hours in total lighting hours, they were all still able to be lighted without extinction and without shifting to pinkish side, and an improvement was attained in the lamp voltage rise during the lighting to be 3.6 V in the average of the twenty lamps and, at the most, 8.9 V.

Similarly, the lamps were subjected to another experiment in which the inner diameter ϕ of the arc tube and the distance d between the electrodes thereof were made constant to be 6 mm and 40 mm respectively, but the pressure of sealed xenon gas was varied to be such five different levels between $2.3\times10^4$ Pa and $5.3\times10^4$ Pa at a temperature of 25° C. as shown in a following Table 10, so as to measure the general color rendering index Ra and color temperature when V/d=2.0 and W/ϕ=25 to measure the effect occurring in the respective lamps.

TABLE 10

| Example | Com. Ex. 1 | Ex. 1 | Ex. 2 | Ex. 3 | Ex. 4 |
|---|---|---|---|---|---|
| Xe Gas Press. ($\times10^4$ Pa) | 2.3 | 2.5 | 2.7 | 4.0 | 5.3 |
| Gen. Col. Rend. Index Ra | 76 | 80 | 83 | 85 | 82 |
| Col. Temp. (K) | 2380 | 2430 | 2480 | 2570 | 2710 |

From the results shown in the above Table, it has been found that such good optical characteristics exhibit as the general color rendering index Ra of 80 and the color temperature of 2430K when the pressure of the xenon gas shown in the embodiment 4 is $2.5\times10^4$ Pa, but the xenon gas cannot play sufficiently the roll of the buffer gas when the gas pressure becomes less than $2.5\times10^4$ Pa as in a comparative example 1, thus deteriorating the optical characteristics of the general color rendering index Ra and color temperature. For this reason, the pressure of the sealed xenon gas was set to be more than $2.5\times10^4$ Pa.

Lamps were manufactured for trial by making the pressure of the xenon gas of the arc tube 1 to be constantly $2.5\times10^4$ Pa and varying the inner diameter ϕ (mm) of the arc tube 1 and the distance d (mm) between the both electrodes 6 and 7. The manufactured lamps were then subjected to a lighting evaluation by changing a voltage (lamp voltage) V(V) to be applied to the lamp and the impedance of the ballast, with such measurement results as shown in a following table 11.

TABLE 11

| | Com.Ex. 2 | Com.Ex. 3 | Ex. 5 | Ex. 6 | Ex. 7 | Ex. 8 | Com.Ex. 4 | Com.Ex. 5 |
|---|---|---|---|---|---|---|---|---|
| V/d (V/mm) | 1.8 | 1.8 | 2.0 | 2.0 | 2.4 | 2.7 | 2.9 | 3.1 |
| W/ϕ (W/mm) | 18 | 20 | 22 | 22 | 25 | 28 | 29 | 34 |
| Gen. Col. Rend. Index Ra | 76 | 78 | 80 | 82 | 86 | 83 | 82 | 80 |
| Col. Temp. (K) | 2380 | 2460 | 2500 | 2530 | 2590 | 2680 | 2760 | 2840 |
| Lamp Effi. (lm/W) | 65 | 62 | 58 | 57 | 52 | 50 | 44 | 41 |

That is, under a condition that the pressure of the sealed xenon gas is made constant to be $4\times10^4$ Pa; as V/d and W/ϕ are increased, the color temperature increases monotonously. On the other hand, as V/d and W/ϕ are increased, the general color rendering index Ra increases up to 86; and as they are further increased, the number Ra drops from 86, with the saturation increased to the contrary. As V/d and W/ϕ are increased, meanwhile, the lamp efficiency η decreases monotonously. From the above results, it has been found that, when adjustment is made to meet both formulas (1) and (2) which follow, there can be obtained a high pressure sodium vapor lamp with high color rendering which exhibits good optical characteristics such as the general color rendering index Ra of more than 80 and the lamp efficiency η higher than 501 m/W and the color temperature higher than 2400K.

$$2.0 \leqq V/d \leqq 2.7 \quad (1)$$

$$20 \leqq W/\phi \leqq 28 \quad (2)$$

With such an arrangement as mentioned above, in accordance with the present embodiment, when xenon gas is charged in the arc tube 1 at a temperature of 25° C. to be more than $2.5\times10^4$ Pa, and two formulas (1) and (2) which follow are made to be satisfied, where V(V) denotes the lamp voltage upon the lighting, W(W) denotes the lamp power, ϕ (mm) denotes the inner diameter of the arc tube 1 and d (mm) denotes the distance between the both electrodes; there was able to obtain a high pressure sodium vapor lamp which has a high warm color rendering similar to the light color of an incandescent lamp.

$$2.0 \leqq V/d \leqq 2.7 \quad (1)$$

$$20 \leqq W/\phi \leqq 28 \quad (2)$$

Further, since the inner diameter of the arc tube 1 was able to be made to be relatively small, this enabled elimination of the need for providing a heat insulating material for increasing the coldest temperature point of the arc tube 1, which resulted in that the lamp structure was made simple and the high pressure sodium vapor lamp with high color rendering was able to be manufactured less costly.

EMBODIMENT 5

Next, the fifth embodiment of the present invention will be detailed with reference to FIG. 2 as in the fourth embodiment. The high pressure sodium vapor lamp with high color rendering of present embodiment is the same in arrangement as the foregoing fourth embodiment, except that a very small amount of mercury is sealed, in addition to sodium and xenon gases, in the interior of the arc tube 1.

More specifically, the high pressure sodium vapor lamp with high color rendering is arranged so that 0.7 mg of mercury is sealed, together with 5 mg of metallic sodium and xenon gas of a pressure of $4\times10^4$ Pa and a temperature of 25° C., in the interior space (as a discharge space having an inside volume of 1.5 $cm^3$) of the arc tube 1 defined similarly to in the fourth embodiment, and the arc tube 1 is disposed within the outer envelope 9 similar to that of the fourth embodiment.

When the high pressure sodium vapor lamp thus arranged was operated with a choke type ballast incorporating an igniter, with a lamp wattage (lamp power) of 150 W; such high color rendering was obtained as a lamp efficiency η of 541 m/W, color temperate of 2,590K, and general color rendering index Ra of 86, the chromaticity point was present on the black body locus, thus the tone of light color never become greenish. In this connection, assuming that a lamp voltage upon the lighting is denoted by V(V), the inner diameter of the arc tube 1 is by ϕ(mm), the distance between the electrodes 6 and 7 is by d (mm); then relationships of V/d=2.5 and W/ϕ=25 were satisfied.

Twenty of the high pressure sodium vapor lamps having the same arrangement were manufactured and were subjected to a lighting experiment at an ON/OFF cycle of lighting ON for 5.5 hours and lighting OFF for 0.5 hours. Even after 12,000 hours in total lighting hours, they were all still able to be lighted without shifting to pinkish side and without extinction, and with a good result attained in the lamp voltage rise during the lighting to be 4.1 V in the average of the twenty lamps and, at the most, 10.4 V.

Similarly, the lamps were subjected to another experiment in which the inner diameter ϕ of the arc tube and the distance d between the electrodes thereof were made constant to be 6 mm and as constant as 40 mm respectively (V/d=2.5, W/ϕ=25), but the pressure of sealed xenon gas was varied to be such five different levels between $2.3\times10^4$ Pa and $5.3\times10^4$ Pa as shown in a following Table 12, so as to measure the influence to the optical characteristics in the respective lamps. Mercury was made as constant as 0.7 mg and metallic sodium was 5 mg. It has been found that, when the xenon gas pressure is less than $2.5\times10^4$ Pa, the gas cannot play sufficiently the roll of the buffer gas, with the result that the optical characteristics such as the general color rendering index Ra or color temperature are deteriorated. The deviation of the chromaticity point from the black body locus was within ±0.002.

TABLE 12

| Example | Com. Ex. 6 | Ex. 9 | Ex. 10 | Ex. 11 | Ex. 12 |
|---|---|---|---|---|---|
| Xe Gas Press. ($\times10^4$ Pa) | 2.3 | 2.5 | 2.7 | 4.0 | 5.3 |
| Gen. Col. Rend. Index Ra | 77 | 81 | 84 | 85 | 83 |
| Col. Temp. (K) | 2390 | 2440 | 2500 | 2580 | 2730 |

The above results were similar to the results of the fourth embodiment, that is, such good optical characteristics were obtained as the general color rendering index Ra of 80 and the color temperature of 2430K when the pressure of the xenon gas is $2.5\times10^4$ Pa. In this case, the deviation of the chromaticity point from the black body locus was within ±0.002 and the tone of light color was never seen even slightly greenish in the present embodiment, though the deviation of the chromaticity point from the black body locus was within ±0.005 and the tone of light color was seen slightly greenish in the foregoing fourth embodiment.

Lamps were manufactured for trial by making the pressure of the xenon gas to be constantly $4\times10^4$ Pa at a temperature of 25° C. and varying the inner diameter ϕ (mm) of the arc tube 1 and the distance d (mm) between the both electrodes 6 and 7. The manufactured lamps were then subjected to an evaluation experiment by changing a voltage (lamp voltage) V(V) to be applied to the lamp and the impedance of the ballast, with such measurement results as shown in a following table 13.

TABLE 13

| | Com.Ex. 7 | Com.Ex. 8 | Ex. 13 | Ex. 14 | Ex. 15 | Ex. 16 | Ex. 17 | Ex. 18 |
|---|---|---|---|---|---|---|---|---|
| V/d (V/mm) | 1.8 | 1.8 | 2.0 | 2.0 | 2.4 | 2.7 | 2.9 | 3.1 |
| W/ϕ (W/mm) | 18 | 20 | 20 | 22 | 25 | 28 | 29 | 34 |
| Gen. Col. Rend. Index Ra | 77 | 78 | 80 | 83 | 86 | 83 | 81 | 80 |
| Col. Temp. (K) | 2390 | 2470 | 2500 | 2540 | 2600 | 2690 | 2770 | 2850 |
| Lamp Effi. (lm/W) | 63 | 61 | 57 | 56 | 50 | 46 | 42 | 39 |

Even under conditions that the pressure of the sealed xenon gas is made constant to be $4\times10^4$ Pa at a temperature of 25° C. and mercury is sealed; when formulas (1) and (2) which follow were made to be satisfied, there was able to obtained a high pressure sodium vapor lamp which has a high color rendering, with optical characteristics of the general color rendering index Ra of 80 or more, lamp efficiency η of 45 lm/W or more and color temperature of 2400K or more.

$$2.0 \leqq V/d \leqq 2.7 \quad (1)$$

$$20 \leqq W/\phi \geqq 28 \quad (2)$$

In this case, the deviation of the chromaticity point was within ±0.002.

Further, the similar arc tubes 1 (having an inside volume of 1.5 $cm^3$) were used and subjected to measurements of the deviation of the chromaticity point from the black body locus, by making the pressure of the xenon gas to be constantly $4\times10^4$ Pa and changing the amount of mercury to be sealed in a range of 0 mg–1.5 mg (0.8 $mg/cm^3$). The measurement results were as shown in a following table 14.

TABLE 14

| | Com.Ex. 9 | Com.Ex. 10 | Com.Ex. 11 | Ex. 19 | Ex. 20 | Ex. 21 | Com.Ex. 12 | Com.Ex. 13 | Com.Ex. 14 |
|---|---|---|---|---|---|---|---|---|---|
| Mer. Amt. (mg) | 0.00 | 0.30 | 0.42 | 0.45 | 0.70 | 1.20 | 1.27 | 1.35 | 1.50 |
| Diviat. of Chromat. Pt (×1000) | 5.0 | 3.4 | 2.8 | 2.0 | 0.2 | −2.0 | −2.7 | −3.1 | −4.1 |

It has been found from the results of the above table that, as far as the mercury amount is above 0.45 mg and below 1.2 mg, that is, is in a range of above 0.3 mg and below 0.8 mg per unit volume (1 $cm^3$) of the arc tube, the deviation of the chromaticity point from the black body locus is within ±0.002.

In the high pressure sodium vapor lamp of the present embodiment arranged as mentioned above, in addition to the effects of the foregoing fourth embodiment, even when metallic sodium reacts with the materials of the arc tube during the operation and disappears, change in the ratio of mercury to sodium is very small because the mount of sealed mercury is very small, whereby the tone of light color never been seen pinkish. And the deviation of the chromaticity point from the black body locus was within ±0.002. As a result, it can be prevented that the tone of light color is seen greenish and thus there was able to obtained a high pressure sodium vapor lamp which has a high warm color rendering properties similar to the light color of an incandescent lamp.

Although the pressure of the sealed xenon gas has been made to be $5.4\times10^4$ Pa as its maximum in the foregoing embodiments, the present embodiment is not limited to the specific example. For example, when an E26 or E39 type lamp base is employed, the xenon gas pressure is set preferably at about $2.5\times10^4$ Pa to about $6.6\times10^4$ Pa from the viewpoint of its breakdown voltage. This is because the higher the xenon gas pressure is the higher the starting voltage is, and when the starting voltage is increased and exceeds 5000 V, which the usual E26 or E39 type lamp base cannot sufficiently withstand. When the breakdown voltage becomes insignificant like a lamp base of a type having bases at its both ends, the xenon gas pressure can be set at a level higher than the 5000 V.

What is claimed is:

1. A high pressure sodium vapor lamp with high color rendering in which rare gas and metallic sodium are sealed in a mercury-free interior of a light-transmitting arc tube provided at both of its ends with electrodes, a pressure of said sealed rare gas is set at a value to cause a general color rendering index Ra to be 80 or more.

2. A high pressure sodium vapor lamp with high color rendering according to claim 1, wherein a color temperature is set at 2400K or more.

3. A high pressure sodium vapor lamp with high color rendering according to claim 1, wherein, when said rare gas is xenon gas, the sealed pressure thereof is set to be above $2.5\times10^4$ Pa and below $5.3\times10^4$ Pa.

4. A high pressure sodium vapor lamp with high color rendering according to claim 1, wherein, when said rare gas is krypton gas, the sealed pressure thereof is set to be above $3\times10^4$ Pa and below $5.3\times10^4$ Pa.

5. A high pressure sodium vapor lamp with high color rendering according to claim 1, wherein, when said rare gas is argon gas, the sealed pressure thereof is set to be above $3.3\times10^4$ Pa and below $5.3\times10^4$ Pa.

6. A high pressure sodium vapor lamp with high color rendering according to claim 5, wherein a color temperature is set at 2400K or more, and a tube wall loading of said arc tube is set at a predetermined value to set a tube wall temperature of the arc tube at 1200° C. or less.

7. A high pressure sodium vapor lamp with high color rendering according to claim 1, wherein said lamp has a double structure of the arc tube and an outer envelope, inert gas being sealed within said outer envelope.

8. A high pressure sodium vapor lamp with high color rendering according to claim 7, wherein said inert gas sealed in said outer envelope contains one or more of nitrogen and krypton.

9. A high pressure sodium vapor lamp with high color rendering in which rare gas and metallic sodium are sealed in a light-transmitting arc tube provided at both of its ends with electrodes, a pressure of said sealed rare gas is set at a value to cause a general color rendering index Ra to be 80 or more, wherein a tube wall loading of said arc tube is set at a predetermined value and a tube wall temperature of the arc tube is set at 1200° C. or less.

10. A high pressure sodium vapor lamp with high color rendering according to claim 9, wherein, when said rate gas is argon gas, the sealed pressure thereof is set to be above $3.3\times10^4$ Pa and below $5.3\times10^4$ Pa, and a tube wall loading of said arc tube is set to be above 39.5 W/cm$^2$ and below 55.7 W/cm$^2$.

11. A high pressure sodium vapor lamp with high color rendering according to claim 9, wherein, when said rate gas is xenon gas, the sealed pressure thereof is set to be above $2.5\times10^4$ Pa and below $5.3\times10^4$ Pa, and a tube wall loading of said arc tube is set to be above 34.7 W/cm$^2$ and below 62 W/cm$^2$.

12. A high pressure sodium vapor lamp with high color rendering according to claim 9, wherein, when said rate gas is krypton gas, the sealed pressure thereof is set to be above $3\times10^4$ Pa and below $5.3\times10^4$ Pa, and a tube wall loading of said arc tube is set to be above 36.1 W/cm$^2$ and below 54.3 W/cm$^2$.

13. A high pressure sodium vapor lamp with high color rendering in which rare gas and metallic sodium are sealed in a light-transmitting arc tube provided at both of its ends with electrodes, a pressure of said sealed rare gas is set at a value to cause a general color rendering index Ra to be 80 or more, wherein said lamp has a double structure of the arc tube and an outer envelope, inert gas being sealed within said outer envelope, and the relationship of $2.0 \leqq V/d \leqq 2.7$ and $20 \leqq W/\phi \leqq 28$ is satisfied, wherein V being a lamp voltage (V), "d" being a distance (mm) between the electrodes, W being a lamp power (W) and $\phi$ being an inner diameter (mm) of the arc tube.

14. A high pressure sodium vapor lamp with high color rendering according to claim 13, wherein mercury is sealed to cause a deviation of a chromaticity point from a black body locus to be within ±0.002.

15. A high pressure sodium vapor lamp with a high color rendering, comprising a light-transmitting outer envelope with an inert gas sealed therein, and a light-transmitting arc tube enclosed in the outer envelope, the arc tube having at both ends a pair of opposing electrodes, there being a rare gas, metallic sodium and mercury sealed within the arc tube, the rare gas being set at a value to cause a general color rendering index Ra to be 80 or more, and weight of mercury being in a range of 0.3–0.8 mg, wherein the relationship of $2.0 \leqq V/d \leqq 2.7$ and $20 \leqq W/\phi \leqq 28$ is satisfied, in which V being a lamp voltage (V), "d" being a distance (mm) between the opposing electrodes, W being a lamp power (W), and $\phi$ being an inner diameter (mm) of the arc tube.

* * * * *